US008226780B2

(12) United States Patent
Hatano et al.

(10) Patent No.: US 8,226,780 B2
(45) Date of Patent: Jul. 24, 2012

(54) FERRITE-AUSTENITE STAINLESS STEEL SHEET EXCELLENT IN RIDGING RESISTANCE AND WORKABILITY AND PROCESS FOR MANUFACTURING THE SAME

(75) Inventors: Masaharu Hatano, Hikari (JP); Akihiko Takahashi, Hikari (JP); Eiichiro Ishimaru, Hikari (JP); Ken Kimura, Futtsu (JP)

(73) Assignees: Nippon Steel, Tokyo (JP); Sumikin Stainless Steel Corporation, Tokyo (JP)

( * ) Notice: Subject to any disclaimer, the term of this patent is extended or adjusted under 35 U.S.C. 154(b) by 164 days.

(21) Appl. No.: 12/735,615

(22) PCT Filed: Jan. 30, 2009

(86) PCT No.: PCT/JP2009/051611

§ 371 (c)(1),
(2), (4) Date: Jul. 29, 2010

(87) PCT Pub. No.: WO2009/099010

PCT Pub. Date: Aug. 13, 2009

(65) Prior Publication Data

US 2011/0000589 A1 Jan. 6, 2011

(30) Foreign Application Priority Data

Feb. 5, 2008 (JP) ..... 2008-025112
Dec. 25, 2008 (JP) ..... 2008-330428

(51) Int. Cl.

| | |
|---|---|
| ***C22C 38/18*** | (2006.01) |
| ***C22C 38/40*** | (2006.01) |
| ***C22C 38/42*** | (2006.01) |
| ***C21D 8/02*** | (2006.01) |
| ***C21D 8/04*** | (2006.01) |

(52) U.S. Cl. ..... 148/325; 148/404; 148/610; 148/611

(58) Field of Classification Search ..... 148/325, 148/404, 608–611

See application file for complete search history.

(56) References Cited

U.S. PATENT DOCUMENTS 6,096,441 A 8/2000 Hauser et al.
6,383,309 B2 * 5/2002 Hirata et al. ..... 148/325
6,645,324 B2 * 11/2003 Hirata et al. ..... 148/651

(Continued)

FOREIGN PATENT DOCUMENTS

JP 9-263900 10/1997

(Continued)

OTHER PUBLICATIONS

Aoki et al. "Development of a High Strength Duplex Stainless Steel NAR-DS-1", Nippon Stainless Technical Report, vol. 21(1986) p. 12 [English abstract].

(Continued)

*Primary Examiner* — Deborah Yee
(74) *Attorney, Agent, or Firm* — Kenyon & Kenyon LLP

(57) ABSTRACT

This ferrite-austenite stainless steel sheet includes: in terms of mass %, C: 0.1% or less; Cr: 17 to 25%; Si: 1% or less; Mn: 3.7% or less; Ni: 0.6 to 3%; Cu: 0.1 to 3%; and N: 0.06% or more and less than 0.15%, with the remainder being Fe and inevitable impurities, wherein the steel sheet has a two-phase structure consisting of a ferrite phase and an austenite phase, a volume fraction of the austenite phase is in a range of 15 to 70%, and in a sheet plane (ND) of a center of a sheet thickness, grains of the ferrite phase having a crystal orientation satisfying ND//{111}±10° and grains of the ferrite phase having a crystal orientation satisfying ND//{101}±10° are present in a total content of 10% by area or more.

11 Claims, 1 Drawing Sheet

U.S. PATENT DOCUMENTS

| | | | | |
|---|---|---|---|---|
| 2002/0144756 | A1* | 10/2002 | Hirata et al. | 148/325 |
| 2007/0163679 | A1 | 7/2007 | Fujisawa et al. | |

FOREIGN PATENT DOCUMENTS

| | | |
|---|---|---|
| JP | 10-219407 | 8/1998 |
| JP | 11-71643 | 3/1999 |
| JP | 2000-256749 | 9/2000 |
| JP | 2001-181808 | 7/2001 |
| JP | 2006-169622 | 6/2006 |
| JP | 2006-183129 | 7/2006 |
| JP | 2006-200035 | 8/2006 |
| JP | 2006-233308 | 9/2006 |
| KR | 10-2001-0062057 | 7/2001 |
| WO | WO 02/27056 | 4/2002 |

OTHER PUBLICATIONS

"Effect of annealing temperature on the property of duplex stainless steel sheet" Materials and Processes, CAMP-ISIJ vol. 8 (1995) p. 708 [English abstract].

"Microstructure and Elongation of Duplex Stainless Steel Sheet" Materials and Processes, CAMP-ISIJ vol. 17 (2004) p. 408 [English abstract].

Microscopy; Suzuki Seiichi, vol. 39, No. 2, pp. 121-124 [English abstract], 2004.

International Search Report dated Apr. 28, 2009 issued in corresponding PCT Application No. PCT/JP2009/051611.

* cited by examiner

FERRITE-AUSTENITE STAINLESS STEEL SHEET EXCELLENT IN RIDGING RESISTANCE AND WORKABILITY AND PROCESS FOR MANUFACTURING THE SAME

This application is a national stage application of International Application No. PCT/JP2009/051611, filed 30 Jan. 2009, which claims priority to Japanese Application. Nos. 2008-025112, filed 5 Feb. 2008, and 2008-330428, filed 25 Dec. 2008, each of which is incorporated by reference in its entirety.

TECHNICAL FIELD

The present invention relates to a ferrite-austenite stainless steel sheet excellent in ridging resistance and workability and a process for manufacturing the same.

This application claims priority on Japanese Patent Application No. 2008-25112 filed on Feb. 5, 2008 and Japanese Patent Application No. 2008-330428 filed on Dec. 25, 2008, the contents of which are incorporated herein by reference.

BACKGROUND ART

Austenite stainless steels represented by SUS304 are stainless steels having excellent corrosion resistance and workability and are most commonly used in a wide area including kitchen appliances, home electric appliances, electronic equipment, and the like. However, since the austenite stainless steels contain a large amount of Ni which is expensive due to its scarcity, there will be a problem associated with the propagation and economic efficiency of such austenite stainless steels in the future.

Meanwhile, extreme reduction of carbon and nitrogen contents in steels has become possible with recent improvement of refining technologies, and as a result, ferrite stainless steels of which the corrosion resistance and the workability are enhanced by adding a stabilizing element such as Ti or Nb are used for wide applications. A primary factor responsible for such broad applicability is that the ferrite stainless steels are superior to austenite stainless steels containing a large amount of Ni in terms of economic efficiency. However, the ferrite stainless steels are remarkably inferior to the austenite stainless steel in terms of workability, particularly elongation and uniform elongation of steel materials.

For that reason, there has recently been focus on austenite-ferrite stainless steels which lie midway between the austenite stainless steel and the ferrite stainless steel. Conventionally, the austenite-ferrite stainless steels represented by SUS329J4L still have problems in terms of propagation and economic efficiency because the austenite-ferrite stainless steels contain Ni in an amount of more than 5% and further contains Mo in an amount of several %, and Mo is scarcer and more expensive than Ni.

As an approach to cope with this problem, there has been disclosed an austenite-ferrite stainless steel wherein Mo is contained as an optional addition element and the Ni content is limited to more than 0.1% and less than 1% (Patent Document 1) or is limited to 0.5% or more and 1.7% or less (Patent Document 2). The steels disclosed in examples of these Patent Documents 1 and 2 contains N in an amount of more than 0.1%, and the Mn content is set to be in a range of more than 3.7%, for the purpose of achieving a reduction of the Ni content.

Patent Document 3 and Patent Document 4 disclose austenite-ferrite stainless steels wherein a (C+N) content or a component balance in the austenite phase is adjusted by substantially limiting the Ni content to 3% or less, for the purpose of improving total elongation and deep drawability.

Further, in this connection, examples of Patent Document 5 disclose ferrite stainless steels having excellent ductility, wherein an N content is set to less than 0.06%, a ferrite phase serves as a parent phase and a retained austenite phase is contained in an amount of less than 20%.

Patent Document 6 and Patent Document 7 disclose improvements of crevice corrosion resistance and intergranular corrosion resistance in the austenite-ferrite stainless steel similar to that of Patent Document 3 and Patent Document 4. With regard to the steels disclosed in working examples of Patent Document 6, the Mn content is limited to less than 2%, and N is contained in an amount of more than 0.3% in the case where Ni is added in an amount of more than 0.5%. With regard to the steels disclosed in examples of Patent Document 7, the Mn content is set to be in a range of more than 2% to less than 4%, and the N content is set to be in a range of less than 0.15% in the case where the Ni content is less than 0.6%.

Conventionally, there has been pointed out in Non-Patent Document 1 that duplex steels represented by SUS329J4L which is an austenite-ferrite stainless steel taking a position between the austenite stainless steel and the ferrite stainless steel, undergoes the occurrence of furrow-like roughness along the rolling direction when subjected to a tensile processing. Here, the phenomenon is called ridging. The occurrence of ridging is closely connected with the texture of a ferrite phase, as is the case with the ferrite stainless steels. Non-Patent Document 2 and Non-Patent Document 3 address study and research on the texture of SUS329J4L.

There has been reported in these documents that the ferrite phase retains a rolling texture even after annealing of a hot rolled steel or a repetition of cold rolling and annealing, and as a result, it is difficult to obtain a re-crystallized texture. In this connection, the term "rolling texture" means strong orientation to the {001} orientation and {112} orientation, and ferrite stainless steels are easily susceptible to the occurrence of ridging if the orientation to such crystal orientations is strong. Therefore, it is considered that the occurrence of ridging in the duplex steels is also due to a strong orientation toward the rolling texture and an insufficient recrystallization of the ferrite phase, similar to the ferrite stainless steels.

Regarding the above-mentioned Patent Documents 1 to 7, there is no technology suggesting the occurrence of ridging and the texture as pointed out above. Specifically, the austenite-ferrite stainless steels disclosed in Patent Documents 3 to 7 have good formability; however, the occurrence of ridging due to processing and countermeasures thereagainst are not clearly investigated.

[Patent Document 1] Japanese Unexamined Patent Application, Publication No. H11-071643
[Patent Document 2] Specification of WO/02/27056
[Patent Document 3] Japanese Unexamined Patent Application, Publication No. 2006-169622
[Patent Document 4] Japanese Unexamined Patent Application, Publication No. 2006-183129
[Patent Document 5] Japanese Unexamined Patent Application, Publication No. H10-219407
[Patent Document 6] Japanese Unexamined Patent Application, Publication No. 2006-200035
[Patent Document 7] Japanese Unexamined Patent Application, Publication No. 2006-233308
[Non-Patent Document 1] Nippon Stainless Technical Report, vol. 21 (1986), p 12

[Non-Patent Document 2] Materials and Processes 8 (1995), p 708

[Non-Patent Document 3] Materials and Processes 17 (2004), p 408

DISCLOSURE OF THE INVENTION

Problems to be Solved by the Invention

The present invention aims to provide a ferrite-austenite stainless steel sheet and a process for manufacturing the same which is excellent in the ridging resistance and workability by specifying a ferrite phase texture of a steel sheet and a phase balance between the ferrite phase and the austenite phase and controlling the steel composition and hot rolling conditions.

Means for Solving the Problems

In order to solve the above-mentioned problems, the inventors of the present invention have conducted intensive studies on a texture-phase balance relationship to guarantee a compatibility of ridging resistance and workability of a ferrite-austenite stainless steel for the purpose of achieving a reduction of amounts of alloying elements, such as realizing a low content of Ni and saving a content of Mo, and the composition of a steel and the manufacturing conditions for realization of the above-mentioned purpose.

As a result, the inventors of the present invention found that an increase of a {111}+{101} area ratio of a ferrite phase (total area ratio of crystal grains (crystallographically oriented grains) having a crystal orientation satisfying ND/{111}±10° and crystal grains (crystallographically oriented grains) having a crystal orientation satisfying) ND//{101}±10° is effective for the reduction of a ridging height, and low-alloy duplex steels (duplex steels having low contents of alloying elements) are more favorable than high-alloy duplex steels (duplex steels having high contents of alloying elements) in order to increase the {111}±{101} area ratio of the ferrite phase. Further, the inventors of the present invention found that in the case where a volume fraction of the austenite phase (γ phase fraction %) is in a range of 15 to 70%, a uniform elongation becomes 30% or more which is a desired level, so the uniform elongation is increased by work-induced martensite transformation of the γ phase.

Further, the present inventors found that the dominant factor of the ridging resistance and the workability is a crystal orientation of the ferrite phase ({111}+{101} area ratio) and the γ phase fraction.

Further, the present inventors found the followings. The crystal orientation of the ferrite phase is influenced by the hot rolling conditions together with the composition. Therefore, in order to promote recrystallization of the ferrite phase so as to increase the {111}+{101} area ratio, it is preferable to carry out a rough rolling in a high-temperature range in which an austenite phase exists and a large amount of a ferrite phase is formed. In addition, the γ phase fraction is influenced by the temperature of a finish annealing after a cold rolling and therefore, the temperature of the finish annealing is preferably in a range of 900 to 1200° C. in order to control the γ phase fraction to be in a range where a maximum value of the uniform elongation is obtained.

The present invention has been completed based on these findings. The features of the present invention are as follows.

(1) A ferrite-austenite stainless steel sheet having excellent ridging resistance and workability, the steel sheet contains: in terms of mass %, C: 0.1% or less; Cr: 17 to 25%; Si: 1% or less; Mn: 3.7% or less; and N: 0.06% or more and less than 0.15%, wherein the steel sheet has a two-phase structure consisting of a ferrite phase and an austenite phase, a volume fraction of the austenite phase is in a range of 15 to 70%, and in a sheet plane (ND) of a center of a sheet thickness, grains of the ferrite phase having a crystal orientation satisfying ND//{111}±10° and grains of the ferrite phase having a crystal orientation satisfying ND//{101}±10° are present in a total content of 10% by area or more.

(2) A ferrite-austenite stainless steel sheet having excellent ridging resistance and workability, the steel sheet contains: in terms of mass %, C: 0.1% or less; Cr: 17 to 25%; Si: 1% or less; Mn: 3.7% or less; Ni: 0.6 to 3%; Cu: 0.1 to 3%; and N: 0.06% or more and less than 0.15%, with the remainder being Fe and inevitable impurities, wherein the steel sheet has a two-phase structure consisting of a ferrite phase and an austenite phase, a volume fraction of the austenite phase is in a range of 15 to 70%, and in a sheet plane (ND) of a center of a sheet thickness, grains of the ferrite phase having a crystal orientation satisfying ND//{111}±10° and grains of the ferrite phase having a crystal orientation satisfying ND//{101}±10° are present in a total content of 10% by area or more.

(3) The ferrite-austenite stainless steel sheet having excellent ridging resistance and workability according to (2), the steel sheet may further contain, in terms of mass %, one or more selected from the group consisting of Al: 0.2% or less, Mo: 1% or less, Ti: 0.5% or less, Nb: 0.5% or less, B: 0.01% or less, Ca: 0.01% or less, Mg: 0.01% or less, and rare-earth elements: 0.5% or less.

(4) The ferrite-austenite stainless steel sheet having excellent ridging resistance and workability according to any one of (1) to (3), wherein a uniform elongation measured by a tensile testing may be in a range of 30% or more.

(5) A process for manufacturing a ferrite-austenite stainless steel sheet having excellent ridging resistance and workability, the process includes: heating a stainless steel slab having the steel composition according to any one of (1) to (3) at a temperature within a range of 1150 to 1300° C.; subjecting the heated stainless steel slab to a hot rolling including a hot rough rolling and a hot finish rolling after the hot rough rolling to form a hot-rolled steel sheet; and annealing the hot-rolled steel sheet, wherein, in the hot rough rolling, a multi-pass rolling is carried out under conditions where a rolling start temperature is in a range of 1150° C. or higher, a rolling end temperature is in a range of 1050° C. or higher, and a pass interval is in a range of 2 seconds or more to 60 seconds or less, and a steel sheet is manufactured which has a two-phase structure consisting of a ferrite phase and an austenite phase, in which a volume fraction of the austenite phase is in a range of 15 to 70%, and in a sheet plane (ND) of a center of a sheet thickness, grains of the ferrite phase having a crystal orientation satisfying ND//{111}±10° and grains of the ferrite phase having a crystal orientation satisfying ND//{101}±10° are present in a total content of 10% by area or more.

(6) The process for manufacturing a ferrite-austenite stainless steel sheet having excellent ridging resistance and workability according to (5), wherein, in the hot rough rolling, a number of passes having a rolling reduction rate of 20% or more may be ½ or more of the total number of passes, and a rolling reduction rate of a pass having the highest rolling reduction rate may be in a range of 50% or more, or a total of rolling reduction rates of two passes having high rolling reduction rates may be in a range of 50% or more.

(7) The process for manufacturing a ferrite-austenite stainless steel sheet having excellent ridging resistance and workability according to (5) or (6), wherein an end temperature of the hot finish rolling may be set to be in a range of 900° C. or higher.

(8) The process for manufacturing a ferrite-austenite stainless steel sheet having excellent ridging resistance and workability according to any one of (5) to (7), the process may further include: subjecting the annealed hot-rolled steel sheet to one pass of a cold rolling at a rolling reduction rate of 50% or more, or two or more passes of a cold rolling with an intermediate annealing therebetween under conditions where a total of rolling reduction rates is in a range of 50% or more, thereby forming a cold-rolled steel sheet; and subjecting the cold-rolled steel sheet to finish annealing at a temperature within a range of 900 to 1200° C.

Hereinafter, the invention relating to the steels of (1) to (4) and the invention relating to the manufacturing process of (5) to (8) are respectively referred to as "present invention". Further, a combination of the inventions of (1) to (8) is often referred to as "present invention".

Effects of the Invention

In accordance with the present invention, by specifying a crystal orientation of a ferrite phase and a volume fraction of an austenite phase, and controlling the composition and manufacturing conditions in a timely manner, it is possible to obtain a ferrite-austenite stainless steel sheet which is excellent in ridging resistance equivalent to that of SUS304 and workability approximate or equal to that of SUS304, particularly which has a uniform elongation of 30% or more measured by a tensile testing. Here, the uniform elongation serves as an indicator of the workability.

BEST MODE FOR CARRYING OUT THE INVENTION

Figure 1:
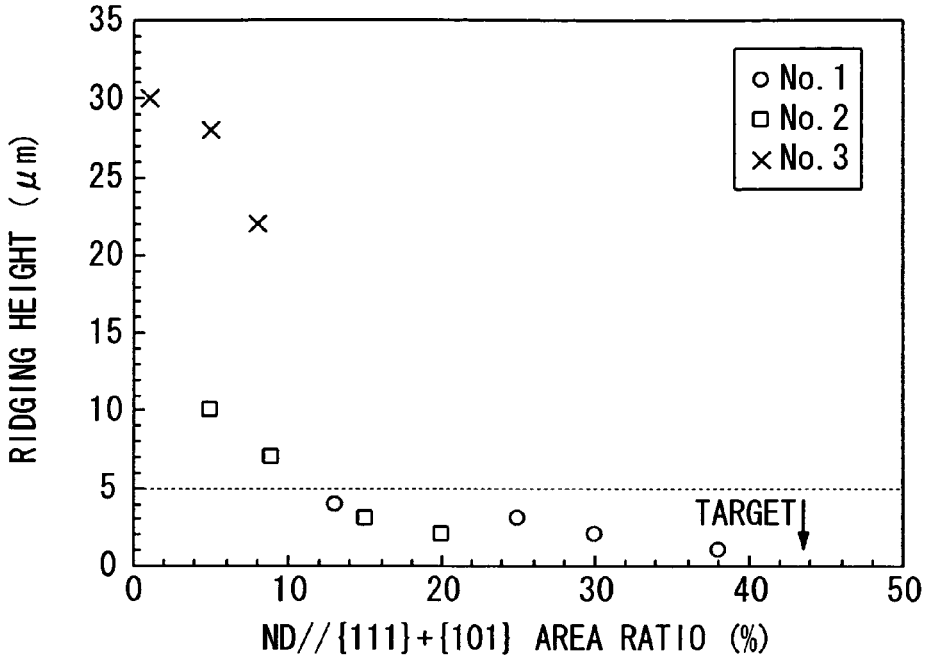
FIG. 1 is a view illustrating a relationship between ridging and texture.

Hereinafter, the present invention will be described in more detail.

Firstly, representative experimental results reached to complete the present invention will be described.

Ferrite-austenite stainless steels of which the compositions are given as Steel No. 1 and Steel No. 2 of Table 1 were manufactured as follows. Steels were vacuum-melted and hot-rolled to prepare hot-rolled steel sheets having a thickness of 5 mm. An annealing of the hot-rolled steel sheets was carried out at 1000° C., and then a pickling and a cold rolling was carried out to prepare cold-rolled steel sheets having a thickness of 1 mm. An annealing of the cold-rolled steel sheets was carried out at a temperature in a range of 900 to 1200° C., and then a forced air-cooling was carried out at an average cooling rate in a range of 35 to 40° C./sec until the temperature reached 200° C. A texture in the sheet plane of the center of the sheet thickness, a volume fraction of an austenite phase (hereinafter, referred to as "γ phase fraction"), a ridging height, and a uniform elongation were measured for the cold-rolled and annealed steel sheets. The relationship between the texture and the ridging height was investigated using a conventional SUS329J4L product given in Steel No. 3 as a comparative material. The texture and the γ phase volume fraction of the steel were changed by controlling the hot rolling conditions and the temperature at which the cold-rolled steel sheets were annealed within a temperature range of 900 to 1200° C.

TABLE 1

| Steel | Chemical composition (mass %) | | | | | | | |
|---|---|---|---|---|---|---|---|---|
| No. | C | Si | Mn | Cr | N | Ni | Cu | Mo |
| 1 | 0.03 | 0.1 | 2.9 | 21 | 0.08 | 1.6 | 0.5 | — |
| 2 | 0.01 | 0.4 | 1.0 | 21 | 0.14 | 3.2 | 0.5 | — |
| 3 | 0.02 | 0.6 | 0.7 | 25 | 0.11 | 6.8 | — | 3.0 |

With regard to the texture in the sheet plane (hereinafter referred to as "ND") of the center of the sheet thickness, crystal structures of fcc (γ phase) and bcc (ferrite phase) were identified by an EBSP method, and a crystal orientation of the ferrite phase was measured. The measurement was made at magnification of ×100. Based on the measurement results of the crystal orientation, a total area ratio of crystal grains (crystallographically oriented grains) of the ferrite phase having a crystal orientation satisfying ND//{111}±10° and crystal grains (crystallographically oriented grains) of the ferrite phase having a crystal orientation satisfying ND//{101}±10° was calculated.

As used herein, the term "ND//{111}±10°" means that {111} orients in a range of −10° to +10° with respect to the sheet plane (ND), and the term "ND//{101}±10°" means that {101} orients in a range of −10° to +10° with respect to the sheet plane (ND). Further, the area ratio of the crystal grains of the ferrite phase having the above-mentioned crystal orientation is an area ratio relative to the entire sheet plane.

A volume fraction of the γ phase (γ phase fraction) was measured by embedding a cross-sectional portion of the steel sheet in a resin, polishing the embedded steel sheet, then etching the steel sheet by using a potassium ferricyanide solution (trade name: Murakami's reagent), and observing the steel sheet under a light microscope. In the case where the test sheet is etched by using a potassium ferricyanide solution, the ferrite phase appears as a grey color and the austenite phase appears as a white color.

The ridging height was obtained by sampling JIS No. 5 tensile test specimens taken in parallel to the rolling direction, then applying 16% of a tensile strain to the test specimens, and measuring the surface roughness by using a roughness meter.

The uniform elongation was obtained by sampling JIS13B tensile test specimens taken in parallel to the rolling direction, and measuring an elongation until a constriction is produced at a tension rate of 10 mm/min (within a tension rate range defined by JIS Z 2241).

(a) FIG. 1 shows the relationship between the ridging height and the area ratio (hereinafter referred to as "{111}+{101} area ratio") of the total of the crystal grains of the ferrite phase having a crystal orientation satisfying ND//{111}±10° and the crystal grains of the ferrite phase having a crystal orientation satisfying ND//{101}±10°.

As can be seen from FIG. 1, when the {111}+{101} area ratio is 10% or more, the ridging height becomes 5 μm or less which is a desired value, so the surface roughness is not observed by visual inspection, similar to the case of an austenite stainless steel represented by SUS304. The increasing of the {111}+{101} area ratio of the ferrite phase is an effective way for the reduction of the ridging height.

(b) A low-alloy duplex steel (Steel Nos. 1 and 2) of which the Ni content is low and the Mo content is saved is more favorable than a high-alloy duplex steel (Steel No. 3) in order to increase the {111}+{101} area ratio of the ferrite phase. In addition, with regard to the low-alloy duplex steel, it is more preferable to lower the Ni content and the N content (Steel No. 1 is more preferable).

This is believed to be due to that the {111}+{101} area ratio of the ferrite phase relates to a re-crystallized state of the ferrite phase by hot rolling or subsequent annealing. That is, an intention for lowering the contents of alloying elements promotes the recrystallization of the ferrite phase; and thereby, the {111} orientation, which is a recrystallization orientation of the ferrite phase, develops in the cold-rolled steel material after an annealing of a hot-rolled steel sheet is carried out.

Figure 2:
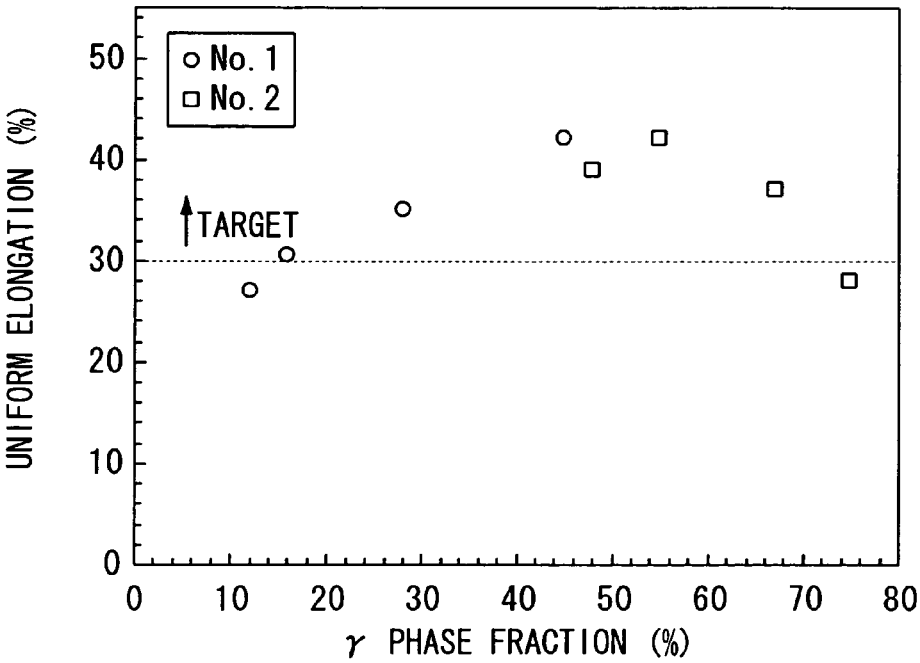
FIG. 2 is a view illustrating a relationship between uniform elongation and a volume fraction of an austenite phase (γ phase fraction %).

(c) FIG. 2 shows the relationship between the γ phase fraction and the uniform elongation.

As can be seen from FIG. 2, when the γ phase fraction is in a range of 15 to 70%, the uniform elongation becomes 30% or more which is a desired level; and therefore, the uniform elongation reaches to an extent that is far superior to those of ferrite stainless steels with enhanced corrosion resistance and workability by an addition of a known stabilizing element such as Ti or Nb and is as same as those of austenite stainless steels.

(d) The uniform elongation is increased by work-induced martensite transformation of the γ phase. As can be seen from the experimental results of FIG. 2, the uniform elongation is not simply increased in accordance with an increase in the γ phase fraction, but takes the maximum value in a specific range of the γ phase fraction.

This is believed to be due to that the composition of the γ phase varies depending on the γ phase fraction even in the steel having the same composition and correspondingly a generation amount of work-induced martensite transformation fluctuates. Accordingly, it is necessary to take into consideration the upper and lower limits of the γ phase fraction in order to obtain a uniform elongation of 30% or more which is considered as an indicator of the workability.

(e) Based on the above-mentioned experimental results, it was found that the dominant factor of ridging resistance and workability is the crystal orientation ({111}+{101} area ratio) of the ferrite phase and the γ phase fraction.

(f) The crystal orientation of the ferrite phase is influenced by the hot rolling conditions, together with the composition as mentioned in (b) above. In order to promote recrystallization of the ferrite phase so as to increase the {111}±{101} area ratio, it is preferable to carry out a rough rolling in a high-temperature range in which an austenite phase exists and a large amount of a ferrite phase is formed.

This is because deformation concentrates in a soft ferrite phase during the rough rolling; and thereby, the recrystallization of the ferrite phase is accelerated. On the other hand, in the case where the rough rolling is carried out in a relatively low-temperature range in which a large amount of an austenite phase is formed, this may lead to extreme concentration of strains into the soft ferrite phase, and this may cause the risk of cracking. Further, in the rough rolling, in order to promote the recrystallization of the ferrite phase, it is preferable to take a pass interval upon rolling and to increase a rolling reduction rate so as to accumulate strains. In the finish rolling subsequent to the rough rolling, it is not preferable to lower the end temperature of the rolling, in view of avoiding cracking during the rolling.

(g) The γ phase fraction is influenced by the temperature of a finish annealing after the cold rolling. The temperature of the finish annealing is preferably in a range of 900 to 1200° C., in order to control the γ phase fraction to be in a range where a maximum value of the uniform elongation can be secured.

The present invention of (1) to (8) have been completed based on the findings of the above (a) to (g).

Hereinafter, each of the features of the present invention will be described in more detail. In addition, "%" in the content of each element denotes "mass %".

(A) The reasons for limiting the metallographic structure will be shown hereinbelow.

In the ferrite-austenite stainless steel of the present invention, the crystal orientation ({111}+{101} area ratio) of the ferrite phase and the γ phase fraction which are the dominant factors are specified in order to attain the target properties of the present invention in both of the ridging resistance and the workability, is made by specifying.

The crystal orientation of the ferrite phase can be measured by an EBSP method. In accordance with the EBSP method, for example, as described in Microscopy; Suzuki Seiichi, Vol. 39, No. 2, pp. 121 to 124, the crystal structures of the austenite phase (fcc) and the ferrite phase (bcc) can be identified and the crystal orientation of the ferrite phase can be visualized. If such a crystal orientation analysis system is used, it is possible to measure the crystal orientation of the ferrite phase which is the dominant factor of the ridging resistance, that is, a total area ratio ({111}+{101} area ratio) of crystal grains of the ferrite phase having a crystal orientation satisfying ND//{111}±10° and crystal grains of the ferrite phase having a crystal orientation satisfying ND//{101}±10°.

The numerical notation of {111} or {101} is based on representation of the inverse pole figure obtained by an analysis system of the above-mentioned EBSP method. A sample parallel to the sheet plane (ND) was sampled at or in the vicinity of the center of the sheet thickness of a steel sheet, and the measurement was made at a magnification of ×100. "{ }" means a notation of Miller Index which represents a crystal plane. That is, equivalent crystal planes such as (−1−1−1), (−111), (1−11), (11−1), (−1−11), (1−1−1), and the like in which "−" denotes a negative symbol are represented as {111} by using "{ }".

In order to obtain the desired ridging resistance of the present invention, the {111}+{101} area ratio is set to be in a range of 10% or more. As demonstrated from the experimental results of FIG. 1, the {111}+{101} area ratio is preferably in a range of 12% or more, and more preferably in a range of 20% or more. Even though the upper limit of the {111}+{101} area ratio is not particularly limited, it is difficult to obtain a {111}+{101} area ratio of more than 50%, while considering the balance of the workability (γ phase fraction) and the manufacturability to be described hereinafter. Therefore, the upper limit is preferably 50% or less.

The γ phase fraction can be measured by the observation using a light microscope. For this purpose, a cross-sectional portion of the steel sheet is embedded in a resin and polished, and then the cross-sectional portion is subjected to an etching treatment which makes it possible to discriminate between the ferrite phase and the austenite phase. That is, in the case where the test sheet is etched in a potassium ferricyanide solution (trade name: Murakami's reagent), the ferrite phase appears as a grey color whereas the austenite phase appears as a white color. The γ phase fraction can be measured by scanning the visual fields obtained by the light microscope into an image analyzer, and performing binarization processing.

The observation using the light microscope was carried out at a magnifying power where the binarization processing of the ferrite phase and the austenite phase can be carried out (for example, 400-fold, and if the magnifying power is low, the phase boundary may not be identified and consequently the binarization may not be carried out), and an observation area for the image processing was set to be in a range of 1 $mm^2$ or more, in order to eliminate a deviation to a particular portion in the visual field.

In order to secure the desired workability of the present invention, the γ phase fraction is set to be in a range of 15 to 70%. If the γ phase fraction is less than 15% or more than 70%, it is difficult to achieve a desired uniform elongation of 30% or more in a low-alloy duplex steel which is targeted by the present invention. A preferred range of the γ phase fraction is in a range of 30 to 60%, as demonstrated from the experimental results of FIG. 2. A more preferred range is in a range of 40 to 60%.

The ferrite-austenite stainless steel having a metallographic structure of the present invention has a ridging height of 5 μm or less and a uniform elongation of 30% or more which is an indicator of workability. Therefore, it is possible to achieve the ridging resistance equivalent to that of SUS304 and the workability which is greatly higher than that of ferrite stainless steels and is approximate or equal to that of SUS304. As used herein, the ridging height is a value obtained by sampling JIS No. 5 tensile test specimens taken in parallel to the rolling direction, then applying 16% of a tensile strain to the test specimens, and measuring the surface roughness by using a roughness meter.

(B) Hereinafter, the reasons for limiting the steel composition will be described.

In the ferrite-austenite stainless steel, the obtaining of the metallographic structure mentioned in Section (A) is affected by the steel composition. The composition is preferably set to fulfill the following ranges.

C is an element which increases a volume fraction of an austenite phase (hereinafter referred to as "γ phase fraction") and is concentrated in the austenite phase to enhance the stability of the austenite phase. In order to achieve the above effects, the content of C is preferably in a range of 0.001% or more. However, if the content of C is higher than 0.1%, a temperature of a heat treatment for solid-solubilizing C remarkably increases, and it is likely to bring about sensitization due to grain boundary precipitation of carbides. Therefore, the content of C is set to be in a range of 0.1% or less, and more preferably in a range of 0.05% or less.

Cr is an essential element for securing corrosion resistance, and the lower limit thereof is necessary to be set to 17% for securing the corrosion resistance. However, if the content of Cr is higher than 25%, this leads to deterioration of toughness and lowering of elongation, and it becomes difficult to form an austenite phase in the steel. Therefore, the content of Cr is set to be in a range of 25% or less. In terms of corrosion resistance, workability, and manufacturability, a preferred range of the Cr content is 19 to 23%. A more preferred range is 20 to 22%.

Si may be added as a deoxidizing element. In order to achieve the above effects, the content of Si is preferably in a range of 0.01% or more. On the other hand, if the content of Si is higher than 1%, this leads to lowering of the solid solubility of N which is an essential element of the present invention. Thereby, sensitization is caused due to nitride precipitation, and consequently, this may result in a risk of remarkable deterioration of the corrosion resistance. Furthermore, it becomes difficult to secure the desired workability of the present invention. Therefore, the content of Si is set to be in a range of 1% or less. Excessive addition of Si leads to an increase in refining costs. In terms of workability and manufacturability, a preferred range of Si content is 0.02 to 0.6%. A more preferred range is 0.05 to 0.2%.

Mn is an element effective for increasing a volume fraction of an austenite phase, and is also effective for improving the workability because Mn is concentrated in the austenite phase to adjust the composition of the austenite phase. Further, Mn is also an effective element in terms of enhancing the solid solubility of N into the austenite phase. In addition, Mn is an effective element as a deoxidizing agent. In order to achieve the above effects, the content of Mn is preferably in a range of 0.5% or more. However, if the content of Mn is higher than 3.7%, this results in deterioration of the corrosion resistance. Therefore, the content of Mn is set to be in a range of 3.7% or less. In terms of workability, corrosion resistance, and manufacturability, a preferred range of the Mn content is 2 to 3.5%. A more preferred range is 2.5 to 3.3%.

Ni, as is the case with Mn, is an element effective for increasing a volume fraction of an austenite phase, and is also effective for improving the workability because Ni is concentrated in the austenite phase to adjust the composition of the austenite phase. In order to achieve the above effects, it is necessary to include Ni at a content in a range of 0.6% or more. However, if the content of Ni is higher than 3%, this brings about increased costs of raw materials. And this also brings about insufficient recrystallization of a ferrite phase during rough rolling, which may lead to deterioration of the desired ridging resistance of the present invention. Therefore, the content of Ni is set to be in a range of 3% or less. In terms of desired ridging resistance and workability of the present invention, and economic efficiency, a preferred range of the Ni content is 0.7 to 2%. A more preferred range is 0.9 to 1.7%.

Cu, as is the case with Mn and Ni, is an austenite-forming element and has the same effect on improving the workability. Further, Cu is an element effective for improving the corrosion resistance. In order to achieve the above effects, it is necessary to include Cu at a content in a range of 0.1% or more. However, if the content of Cu is higher than 3%, this brings about increased costs of raw materials and, similar to Ni, this also brings about deterioration of the desired ridging resistance of the present invention. Therefore, the content of Cu is set to be in a range of 3% or less. In terms of desired ridging resistance and workability of the present invention, and economic efficiency, a preferred range of the Cu content is 0.3 to 1%. A more preferred range is 0.4 to 0.6%.

N is a strong austenite-forming element and is an element effective for improving the workability. In addition, N is an element which is solid-solubilized in an austenite phase to enhance the corrosion resistance. In order to achieve the above effects, it is necessary to include N at a content in a range of 0.06% or more. However, if the content of N is 0.15% or more, this may result in deterioration of the desired ridging resistance of the present invention. Therefore, the content of N is set to be in a range of less than 0.15%. In addition, the addition of N leads to the occurrence of blowholes during dissolution and deterioration of hot workability.

In terms of desired ridging resistance and workability of the present invention, and manufacturability, a preferred range of the N content is 0.07 to 0.14%. A more preferred range is 0.08 to 0.12%.

Al is a strong deoxidizing agent and may be appropriately added. In order to achieve the above effects, it is preferable to include Al in an amount of 0.001% or more. However, if the content of Al is higher than 0.2%, this brings about the formation of nitrides, which may result in the occurrence of surface imperfections and deterioration of the desired ridging resistance and workability of the present invention. Therefore, if Al is included, the upper limit of the Al content is set to 0.2% or less. A preferred range of the Al content is 0.005 to 0.1%.

Mo may be added to improve the corrosion resistance. In the case of including Mo, the content of Mo is preferably set to be in a range of 0.2% or more. However, if the content of Mo is higher than 1%, this may result in deterioration of the desired ridging resistance of the present invention. Therefore, if Mo is included, the upper limit of the Mo content is set to be in a range of 1% or less. A preferred range of the Mo content is 0.2 to 0.8%.

Ti and Nb may be added to improve the corrosion resistance by inhibiting the sensitization generated due to C or N. If Ti or Nd is included, the content of each of Ti and Nb is preferably set to be in a range of 0.01% or more. However, if the content of each of Ti and Nb is higher than 0.5%, this may result in an imparing of the economic efficiency, as well as a deterioration of the desired ridging resistance and workability of the present invention. Therefore, if Ti or Nb is included, the upper limit of each of the Ti content and the Nb content is preferably set to be in a range of 0.5% or less, and a preferred range of each of the Ti content and the Nb content is 0.03 to 0.3%.

B, Ca, and Mg may be appropriately included to improve the hot workability. If B, Ca, or Mg is included, the content of each of B, Ca, and Mg is preferably set to be in a range of 0.0002% or more. However, if the content of each of B, Ca, and Mg is higher than 0.01%, this may remarkably impare the manufacturability. Therefore, if B, Ca, or Mg is included, the upper limit of each of the B content, the Ca content, and the Mg content is set to be in a range of 0.01% or less, and a preferred content range of each of B, Ca, and Mg is 0.0005 to 0.005%.

Rare-earth elements (one or more elements selected from the group consisting of Sc, Y, and the lanthanoids of La, Ce, Pr, Nd, Pm, Sm, Eu, Gd, Tb, Dy, Ho, Er, Tm, Yb, and Lu) may be appropriately included to improve the hot workability, similar to B, Ca, and Mg. If they are included, the content of each of rare-earth elements is preferably set to be in a range of 0.005% or more. However, if the content of each element is higher than 0.5%, this may result in an imparing of the manufacturability and economic efficiency. Therefore, if they are included, the upper limit content of each element is set to be in a range of 0.5% or less, and a preferred content range of each element is in a range of 0.02 to 0.2%.

Further, the stainless steel of the present invention contains iron and inevitable impurities as the remainder, in addition to the above-mentioned components.

As a part of the inevitable impurities, P and S may be included in the following ranges. P and S are elements detrimental to the hot workability and the corrosion resistance. The content of P is preferably set to be in a range of 0.1% or less, and more preferably in a range of 0.05% or less. The content of S is preferably set to be in a range of 0.01% or less, and more preferably in a range of 0.005% or less.

(C) The reasons for limiting the manufacturing process will be shown hereinbelow.

With regard to ferrite-austenite stainless steels, in order to obtain a metallographic structure mentioned in Section (A), there may be no particular limitation to the manufacturing conditions, as long as it has the composition mentioned in Section (B). More preferably, the manufacturing process is preferably carried out using the composition of Section (B), additionally under the following manufacturing conditions.

The crystal orientation of the ferrite phase may be influenced by conditions of hot rolling (hot rough rolling and hot finish rolling), in addition to the composition. In order promote recrystallization of the ferrite phase so as to increase a {111}+{101} area ratio, it is preferable to carry out the rough rolling in a high-temperature range in which an austenite phase exists and a large amount of a ferrite phase is formed.

Accordingly, a slab heating, which is carried out prior to the hot rolling, is preferably carried out at a temperature of 1150 to 1300° C. If the temperature of the slab heating is lower than 1150° C., the formed amount of the austenite phase increases. On the other hand, if the temperature of the slab heating is higher than 1300° C., the grain size of the ferrite phase becomes coarser, which may impair the manufacturability. The temperature of the slab heating is more preferably in a range of 1180 to 1270° C., and still more preferably in a range of 1200 to 1250° C.

The rough rolling is preferably carried out under conditions where the start temperature is in a range of 1150° C. or higher and the end temperature is in a range of 1050° C. or higher. More preferably, the rough rolling is carried out under conditions where the start temperature is in a range of 1200° C. or higher and the end temperature is in a range of 1100° C. or higher.

If the start temperature is 1150° C. or higher, deformation concentrates in the soft ferrite phase; and thereby, the recrystallization of the ferrite phase is accelerated. If the start temperature is lower than 1150° C., cracking may occur due to extreme concentration of strains into the soft ferrite phase. The upper limit of the start temperature is preferably 1250° C., whereby it is possible to control the texture to a desired state of the present invention.

If the end temperature is 1050° C. or higher, cracking of the ferrite phase in the subsequent finish rolling can be avoided. The upper limit of the end temperature is preferably 1100° C., whereby it is possible to control the texture of steel to the desired state of the present invention.

Further, as a method for promoting the recrystallization of the ferrite phase, it is preferable to repeat the multi-pass rolling under conditions where a pass interval is in a range of 2 seconds or more to 60 seconds or less, and the pass interval is preferably in a range of 30 seconds or less. Here, it is more preferable to ensure that a number of passes having a rolling reduction rate of 20% or more accounts for ½ or more of the total number of passes, and a rolling reduction rate of one pass having the highest rolling reduction rate is 50% or more, or a total of rolling reduction rates of two passes having a high rolling reduction rate is 50% or more.

The end temperature of the hot finish rolling after the hot rough rolling is set to be in a range of 900° C. or higher in terms of avoiding rolling cracking. The end temperature of the hot finish rolling is more preferably in a range of 950° C. or higher, and still more preferably in a range of 1000° C. or higher.

After the hot rolling is complete, a hot-rolled steel sheet is preferably subjected to annealing (annealing of the hot-rolled steel sheet) in order to promote the recrystallization of the ferrite phase. The annealing temperature is preferably in a range of 950 to 1150° C. If the annealing temperature is lower than 950° C., the recrystallization of the ferrite phase may be insufficient. If the annealing temperature is higher than 1150° C., the grain size of the ferrite phase becomes coarser, which may cause the occurrence of cracking at the phase boundary of ferrite phase/austenite phase during a cold rolling. The annealing temperature is more preferably in a range of 1000 to 1100° C.

After the annealing of the hot-rolled steel sheet, one pass of a cold rolling may be carried out, or two or more passes of a cold rolling may be carried out with an intermediate annealing therebetween. The temperature of the intermediate annealing may be the same as the temperature of the above-mentioned annealing of the hot-rolled steel sheet. The total rolling reduction rate of the cold rolling is set to be in a range of 50% or more, in order to promote the recrystallization in the annealing of the cold-rolled steel sheet so as to secure the ridging resistance. If the total rolling reduction rate of the cold rolling is less than 50%, the desired ridging resistance of the present invention may be not achieved. Although there is no particular limitation to the upper limit of the rolling reduction rate, the upper limit is preferably in a range of 90% or less. If the upper limit of the rolling reduction rate is higher than 90%, this may cause edge cracking during the cold rolling.

The γ phase fraction is influenced by the temperature of a finish annealing after the cold rolling. The γ phase fraction needs to be in a range of 15 to 70%, preferably in a range of 30 to 60%, in order to secure the desired workability of the present invention. The temperature of the finish annealing is preferably set to be in a range of 900 to 1200° C., in order to control the γ phase fraction to be in a range where a maximum value of a uniform elongation is obtained. If the temperature of the finish annealing is lower than 900° C., the annealing of the cold-rolled steel sheet may be insufficient. If the temperature of the finish annealing temperature is higher than 1200° C., the γ phase fraction is lowered and crystal grains coarsen; and thereby, it is difficult to achieve the desired uniform elongation. The temperature of the finish annealing is more preferably in a range of 950 to 1150° C., and still more preferably in a range of 950 to 1050° C.

EXAMPLES

Hereinafter, the present invention will be described in more detail with reference to Examples.

Ferrite-austenite stainless cast slabs having the compositions given in Table 2 below were melted and formed into steel ingots. Then the steel ingots were subjected to a hot rolling to prepare hot-rolled steel sheets having a sheet thickness of 5.0 mm. Steel Nos. 1 and 2 have the compositions specified by the present invention. Steel Nos. 3 to 16 have the preferred compositions specified by the present invention. Steel Nos. 17 to 22 have the preferred composition specified by the present invention and further including trace elements. Steel Nos. 23 to 29 do not have the composition specified by the present invention. Any of the steels given in Table 2 contains iron and inevitable impurities as the remainder.

In Table 2, "REM" represents rare-earth elements, "–" means no addition of other elements, and the underlined values are values outside the composition specified by claims of the present invention. In addition, "A" in a remarks column represents the composition corresponding to claim 1, "B" represents the composition corresponding to claim 2, C represents the composition corresponding to claim 3, and D represents the composition that does not correspond to any one of claims 1 to 3.

Hot rolling was carried out under the preferred conditions specified by the present invention, as well as under other conditions. The hot-rolled steel sheets were subjected to annealing at 1000° C. and pickling, and then were subjected to one pass of a cold rolling to achieve a thickness of 1 mm, and a finish annealing was carried out. This manufacturing method was utilized as a standard method, and methods under other conditions were also utilized. Other conditions refer to one where the manufacturing was completed up to the annealing and the pickling of the hot-rolled steel sheet (annealed hot-rolled steel sheet), and one where one pass of a cold rolling was carried out to achieve a thickness of 3 mm and then the finish annealing was carried out.

TABLE 2

| Steel | Chemical composition (mass %) | | | | | | | | Re- |
|---|---|---|---|---|---|---|---|---|---|
| No. | C | Si | Mn | Cr | N | Ni | Cu | Others | marks |
| 1 | 0.06 | 0.1 | 2.9 | 20.8 | 0.09 | — | — | — | A |
| 2 | 0.06 | 0.4 | 1.5 | 21.0 | 0.11 | 3.5 | 0.20 | — | A |
| 3 | 0.03 | 0.1 | 3.2 | 21.2 | 0.10 | 1.5 | 0.47 | — | B |
| 4 | 0.01 | 0.3 | 3.1 | 21.0 | 0.11 | 0.9 | 0.45 | — | B |
| 5 | 0.06 | 0.2 | 3.0 | 20.8 | 0.10 | 1.0 | 0.50 | — | B |
| 6 | 0.03 | 0.8 | 3.0 | 21.2 | 0.10 | 1.0 | 0.48 | — | B |
| 7 | 0.03 | 0.3 | 0.5 | 21.0 | 0.11 | 1.0 | 0.47 | — | B |
| 8 | 0.03 | 0.4 | 3.7 | 21.0 | 0.11 | 1.0 | 0.48 | — | B |
| 9 | 0.03 | 0.3 | 3.0 | 21.0 | 0.06 | 1.0 | 0.47 | — | B |
| 10 | 0.03 | 0.2 | 3.1 | 21.0 | 0.14 | 1.0 | 0.47 | — | B |
| 11 | 0.03 | 0.3 | 0.8 | 17.5 | 0.14 | 1.0 | 0.45 | — | B |
| 12 | 0.03 | 0.3 | 3.7 | 24.0 | 0.11 | 1.5 | 0.70 | — | B |
| 13 | 0.03 | 0.4 | 3.2 | 21.0 | 0.11 | 0.6 | 0.45 | — | B |
| 14 | 0.03 | 0.3 | 3.2 | 21.0 | 0.10 | 2.7 | 0.45 | — | B |
| 15 | 0.03 | 0.3 | 3.1 | 21.0 | 0.10 | 1.0 | 0.10 | — | B |
| 16 | 0.03 | 0.4 | 3.1 | 21.0 | 0.10 | 1.0 | 2.80 | — | B |
| 17 | 0.03 | 0.1 | 3.2 | 21.0 | 0.10 | 1.1 | 0.45 | Al: 0.07 | C |
| 18 | 0.03 | 0.1 | 3.2 | 21.0 | 0.10 | 1.1 | 0.45 | Mo: 0.4 | C |
| 19 | 0.03 | 0.1 | 3.1 | 21.0 | 0.10 | 1.0 | 0.46 | Ti: 0.1 | C |
| 20 | 0.03 | 0.1 | 3.1 | 21.0 | 0.10 | 1.0 | 0.48 | Ca, Mg, B: 0.001 | C |
| 21 | 0.03 | 0.1 | 3.1 | 21.0 | 0.10 | 1.0 | 0.48 | REM: 0.05 | C |
| 22 | 0.03 | 0.1 | 3.0 | 21.0 | 0.10 | 1.0 | 0.45 | Nb: 0.4 | C |
| 23 | 0.01 | 0.3 | 0.9 | 20.0 | 0.20 | 0.5 | 0.53 | — | D |
| 24 | 0.01 | 0.3 | 3.2 | 20.0 | 0.05 | 0.5 | 0.50 | — | D |
| 25 | 0.01 | 0.3 | 4.0 | 20.0 | 0.10 | 0.5 | 0.50 | — | D |
| 26 | 0.11 | 0.5 | 1.3 | 21.2 | 0.13 | 1.2 | 0.30 | — | D |
| 27 | 0.04 | 1.1 | 3.1 | 21.3 | 0.10 | 1.0 | 0.48 | — | D |
| 28 | 0.01 | 0.3 | 0.3 | 25.5 | 0.13 | 1.0 | 0.55 | — | D |
| 29 | 0.01 | 0.3 | 0.3 | 16.5 | 0.13 | 1.0 | 0.55 | — | D |

Various test specimens were sampled from the resulting annealed hot-rolled steel sheets and annealed cold-rolled steel sheets, and a crystal orientation of the ferrite phase, a γ phase fraction, a ridging height, and a uniform elongation were evaluated. The crystal orientation of the ferrite phase was measured by an EBSP method, and a {111}+{101} area ratio was determined. The γ phase fraction was measured as follows. A cross-sectional portion of the steel sheet was embedded in a resin, the embedded steel sheet was polished, and then the cross-sectional portion of the steel sheet was subjected to an etching treatment so as to discriminate between the ferrite phase and the austenite phase. Thereafter, an observation was conducted under a light microscope to measure the γ phase fraction. The ridging height was measured as follows. JIS No. 5 tensile test specimens were sampled in parallel to the rolling direction of the steel sheet, and then 16% of a tensile strain was applied to the test specimens. Thereafter, the surface roughness was measured by using a roughness meter.

The uniform elongation was measured as follows. JIS13B tensile test specimens were sampled in parallel to the rolling direction of the steel sheet, and an elongation until a constriction is produced was measured at a tension rate of 10 mm/min (within a tension rate range defined by JIS Z 2241).

Manufacturing conditions are given in Tables 3 and 4, and the texture and characteristics of the finish-annealed steel sheet are given in Tables 5 and 6. As a Comparative Example, the ridging height and the uniform elongation of a SUS304 product having a thickness of 1 mm which was manufactured by actual equipments are also given therein.

In Tables 3 and 4, "$T_1$" represents a start temperature of a rough rolling. "$T_2$" represents an end temperature of a rough rolling. "$T_3$" represents an end temperature of a finish rolling. "2 pass rolling reduction rate" represents a total of rolling reduction rates of consecutive 2 passes where rolling reduction rates were set to high values, among the rough rolling. "*" represents that two passes of cold rolling including intermediate annealing were carried out. "M" represents that a martensite phase was observed. The underlined values refer to values outside the requirements for the manufacturing process or desired texture/characteristics specified by the present invention.

TABLE 3

| Sample No. | Steel No. | Heating (° C.) | Hot rough rolling conditions $T_1$ (° C.) | $T_2$ (° C.) | Pass interval (sec) | 2 pass rolling reduction rate (%) | Proportion of 20% or more passes | Temperature of finish hot-rolling $T_3$ (° C.) | Total rolling reduction rate of cold rolling (%) | Temperature of finish annealing (° C.) |
|---|---|---|---|---|---|---|---|---|---|---|
| 1 | 1 | 1230 | 1200 | 1080 | 10 | 60 | 70 | 980 | 80 | 980 |
| 2 | | 1160 | 1140 | 1030 | <2 | 45 | 50 | 880 | 60 | 1100 |
| 3 | | 1180 | 1150 | 1000 | 20 | 70 | 80 | 850 | 80 | 1050 |
| 4 | 2 | 1230 | 1200 | 1070 | 20 | 70 | 80 | 950 | 80 | 1000 |
| 5 | | 1160 | 1130 | 1020 | <2 | 45 | 50 | 870 | 60 | 1100 |
| 6 | 3 | 1220 | 1200 | 1080 | 15 | 70 | 80 | 950 | 80 | 1000 |
| 7 | | 1220 | 1200 | 1080 | 15 | 70 | 80 | 950 | 80* | 1000 |
| 8 | | 1180 | 1150 | 1050 | <2 | 45 | 50 | 900 | 60 | 1100 |
| 9 | 4 | 1220 | 1200 | 1080 | 15 | 60 | 70 | 970 | 80 | 1000 |
| 10 | 5 | 1210 | 1190 | 1070 | 15 | 60 | 70 | 940 | 80 | 1000 |
| 11 | 6 | 1230 | 1220 | 1100 | 15 | 60 | 70 | 980 | 80 | 1000 |
| 12 | 7 | 1190 | 1180 | 1060 | 15 | 60 | 70 | 920 | 80 | 1000 |
| 13 | 8 | 1230 | 1220 | 1100 | 15 | 60 | 70 | 990 | 80 | 1000 |
| 14 | 9 | 1190 | 1180 | 1060 | 15 | 60 | 70 | 930 | 80 | 1000 |
| 15 | 10 | 1220 | 1210 | 1090 | 15 | 60 | 70 | 960 | 80 | 1000 |
| 16 | 11 | 1240 | 1230 | 1110 | 15 | 60 | 70 | 980 | 80 | 1000 |
| 17 | 12 | 1190 | 1180 | 1050 | 15 | 60 | 70 | 920 | 80 | 1000 |
| 18 | 13 | 1240 | 1230 | 1110 | 15 | 60 | 70 | 1000 | 80 | 1000 |
| 19 | 14 | 1190 | 1180 | 1060 | 15 | 60 | 70 | 950 | 80 | 1000 |
| 20 | 15 | 1240 | 1230 | 1100 | 15 | 60 | 70 | 980 | 80 | 1000 |
| 21 | 16 | 1200 | 1190 | 1090 | 15 | 60 | 70 | 940 | 80 | 1000 |

TABLE 4

| Sample No. | Steel No. | Heating (° C.) | Hot rough rolling conditions $T_1$ (° C.) | $T_2$ (° C.) | Pass interval (sec) | 2 pass rolling reduction rate (%) | Proportion of 20% or more passes | Temperature of finish hot-rolling $T_3$ (° C.) | Total rolling reduction rate of cold rolling (%) | Temperature of finish annealing (° C.) |
|---|---|---|---|---|---|---|---|---|---|---|
| 22 | 17 | 1220 | 1210 | 1070 | 15 | 60 | 70 | 960 | 80 | 1000 |
| 23 | 18 | 1220 | 1210 | 1070 | 15 | 60 | 70 | 960 | 80 | 1000 |
| 24 | 19 | 1220 | 1210 | 1070 | 15 | 60 | 70 | 960 | 80 | 1000 |
| 25 | 20 | 1220 | 1210 | 1070 | 15 | 60 | 70 | 960 | 80 | 1000 |
| 26 | | 1140 | 1130 | 1000 | 15 | 70 | 80 | 830 | 80 | 950 |
| 27 | 21 | 1220 | 1210 | 1070 | 15 | 60 | 70 | 960 | 80 | 1000 |
| 28 | | 1140 | 1130 | 1000 | 15 | 70 | 80 | 830 | 80 | 1050 |
| 29 | 22 | 1240 | 1230 | 1100 | 15 | 60 | 70 | 970 | 80 | 1000 |
| 30 | 23 | 1220 | 1200 | 1080 | 15 | 60 | 70 | 960 | 80 | 950 |
| 31 | 24 | 1200 | 1190 | 1060 | 15 | 60 | 70 | 950 | 80 | 1050 |
| 32 | 25 | 1210 | 1190 | 1070 | 15 | 60 | 70 | 960 | 80 | 925 |
| 33 | 26 | 1220 | 1210 | 1080 | 15 | 60 | 70 | 970 | 80 | 950 |
| 34 | 27 | 1230 | 1220 | 1100 | 15 | 60 | 70 | 970 | 80 | 1120 |
| 35 | 28 | 1190 | 1180 | 1060 | 15 | 60 | 70 | 920 | 80 | 1000 |
| 36 | 29 | 1240 | 1230 | 1110 | 15 | 60 | 70 | 980 | 80 | 1100 |
| 37 | 3 | 1180 | 1160 | 1070 | 50 | 45 | 50 | 880 | — | — |
| 38 | | 1180 | 1160 | 1070 | 50 | 60 | 70 | 880 | — | — |
| 39 | | 1180 | 1160 | 1070 | 30 | 60 | 70 | 920 | — | — |
| 40 | | 1180 | 1160 | 1070 | 50 | 45 | 50 | 880 | 40 | 1100 |
| 41 | | 1180 | 1160 | 1070 | 50 | 60 | 70 | 880 | 40 | 1100 |
| 42 | | 1180 | 1160 | 1070 | 30 | 60 | 70 | 920 | 40 | 1100 |

TABLE 5

| Sample No. | Texture {111} + {101} area ratio (%) | γ phase fraction (%) | Characteristics Ridging height (μm) | Uniform elongation (%) | Remarks |
|---|---|---|---|---|---|
| 1 | 38 | 20 | 2 | 31 | Inventive Example |
| 2 | 8 | 12 | 8 | 20 | Comparative Example |
| 3 | 30 | 17 | 3 | 23 | Comparative Example |

TABLE 5-continued

| Sample No. | Texture {111} + {101} area ratio (%) | γ phase fraction (%) | Characteristics Ridging height (μm) | Uniform elongation (%) | Remarks |
|---|---|---|---|---|---|
| 4 | 15 | 45 | 4 | 41 | Inventive Example |
| 5 | 7 | 37 | 8 | 38 | Comparative Example |
| 6 | 30 | 45 | 2 | 41 | Inventive Example |
| 7 | 40 | 45 | 1 | 41 | Inventive Example |

TABLE 5-continued

| Sample No. | Texture {111} + {101} area ratio (%) | γ phase fraction (%) | Characteristics Ridging height (μm) | Uniform elongation (%) | Remarks |
|---|---|---|---|---|---|
| 8 | 23 | 35 | 3 | 35 | Inventive Example |
| 9 | 20 | 35 | 3 | 37 | Inventive Example |
| 10 | 18 | 38 | 3 | 38 | Inventive Example |
| 11 | 30 | 21 | 2 | 32 | Inventive Example |
| 12 | 28 | 20 | 2 | 30 | Inventive Example |
| 13 | 20 | 55 | 2 | 45 | Inventive Example |
| 14 | 35 | 18 | 1 | 30 | Inventive Example |
| 15 | 20 | 60 | 2 | 48 | Inventive Example |
| 16 | 15 | 67 | 2 | 40 | Inventive Example |
| 17 | 35 | 19 | 1 | 31 | Inventive Example |
| 18 | 25 | 35 | 2 | 38 | Inventive Example |
| 19 | 20 | 60 | 2 | 47 | Inventive Example |
| 20 | 25 | 32 | 2 | 35 | Inventive Example |
| 21 | 25 | 50 | 2 | 40 | Inventive Example |

TABLE 6

| Sample No. | Texture {111} + {101} area ratio (%) | γ phase fraction (%) | Characteristics Ridging height (μm) | Uniform elongation (%) | Remarks |
|---|---|---|---|---|---|
| 22 | 27 | 43 | 2 | 39 | Inventive Example |
| 23 | 25 | 38 | 3 | 34 | Inventive Example |
| 24 | 40 | 40 | 1 | 38 | Inventive Example |
| 25 | 32 | 46 | 2 | 43 | Inventive Example |
| 26 | 35 | 50 | 2 | 45 | Inventive Example |
| 27 | 30 | 42 | 2 | 39 | Inventive Example |
| 28 | 35 | 37 | 2 | 36 | Inventive Example |
| 29 | 28 | 38 | 3 | 37 | Inventive Example |
| 30 | 5 | 65 | 9 | 50 | Comparative Example |
| 31 | 20 | 13 | 3 | 23 | Comparative Example |
| 32 | 7 | 65 | 8 | 45 | Comparative Example |
| 33 | 5 | 75 | 10 | 46 | Comparative Example |
| 34 | 25 | 13 | 4 | 21 | Comparative Example |
| 35 | 30 | 14 | 2 | 27 | Comparative Example |
| 36 | 20 | M | 3 | 28 | Comparative Example |
| 37 | 18 | 40 | 4 | 40 | Inventive Example |
| 38 | 22 | 42 | 3 | 40 | Inventive Example |
| 39 | 23 | 45 | 3 | 40 | Inventive Example |
| 40 | 36 | 42 | 3 | 35 | Inventive Example |
| 41 | 35 | 42 | 3 | 35 | Inventive Example |
| 42 | 37 | 43 | 3 | 35 | Inventive Example |
| SUS304 | — | — | 2 | 45 | Comparative Example |

Sample Nos. 6, 7, 9 to 25, 27, and 29 are samples satisfying the preferred composition and manufacturing process specified by the present invention. These Inventive Examples are ones which satisfied the texture specified by the present invention, that is, a {111}+{101} area ratio of 10% or more and a γ phase fraction of 15 to 70%. Thereby, the desired ridging height of 5 μm or less and the desired uniform elongation of 30% or more of the present invention were achieved. Accordingly, the ferrite-austenite stainless steel obtained by carrying out both the preferred composition and manufacturing process specified by the present invention has ridging resistance equivalent to that of SUS304 and workability approximate or equal to that of SUS304.

Sample Nos. 8, 26, and 28 are samples which had the preferred composition specified by the present invention but were manufactured under conditions outside the preferred manufacturing process specified by the present invention. These samples are ones which satisfied the requirements of the texture specified by the present invention. Thereby, the desired ridging height and uniform elongation of the present invention were achieved. Accordingly, there are cases where it is not necessary to particularly limit the manufacturing process in order to obtain the desired characteristics of the present invention, as long as the preferred composition specified by the present invention is satisfied.

Sample Nos. 1 and 4 are samples which had the composition specified by the present invention and were manufactured under conditions of the preferred manufacturing process specified by the present invention. These samples are ones which satisfied the requirements of the texture specified by the present invention. Thereby, the desired ridging height and uniform elongation of the present invention were achieved. Accordingly, there are cases where it is not necessary to limit the composition to the preferred range specified by the present invention in order to obtain the desired characteristics of the present invention, as long as the preferred manufacturing process specified by the present invention is carried out.

Sample Nos. 37 to 42 had the preferred composition specified by the present invention and were manufactured under conditions of the manufacturing process relating to the preferred hot rolling specified by the present invention. These samples are ones which satisfied the requirements of the texture specified by the present invention. Thereby, the desired ridging height and uniform elongation of the present invention were achieved. Accordingly, there are cases where it is not necessary to particularly limit the manufacturing process regarding the cold rolling after the hot rolling to the preferred range specified by the present invention in order to obtain the desired characteristics of the present invention, as long as the preferred composition and hot rolling conditions specified by the present invention are satisfied.

Sample Nos. 2, 3, and 5 are samples which had the composition specified by the present invention but were manufactured under conditions outside the preferred manufacturing process specified by the present invention. These Comparative Examples are ones which did not satisfy the requirements of the texture specified by the present invention, and as a result, the desired characteristics of the present invention were not achieved.

Sample Nos. 30 to 36 are samples which had the composition outside the composition specified by the present invention, but were manufactured under conditions of the preferred manufacturing process specified by the present invention. These Comparative Examples are ones which failed to achieve the requirements of the texture specified by the present invention and the desired characteristics of the present invention.

INDUSTRIAL APPLICABILITY

The present invention can provide a ferrite-austenite stainless steel sheet having ridging resistance equivalent to that of SUS304 and excellent workability approximate or equal to that of SUS304, particularly a uniform elongation of 30% or more.

The invention claimed is:

1. A ferrite-austenite stainless steel sheet having excellent ridging resistance and workability, the steel sheet comprising: in terms of mass %, C: 0.1% or less;

Cr: 17 to 25%;

Si: 1% or less;

Mn: 3.7% or less;

N: 0.06% to less than 0.15%, and a balance of Fe and unavoidable impurities;

wherein the steel sheet has a two-phase structure consisting of a ferrite phase and an austenite phase, a volume fraction of the austenite phase is in a range of 15 to 70%, and in a sheet plane (ND) of a center of a sheet thickness, grains of the ferrite phase having a crystal orientation satisfying ND//{111}±10° and grains of the ferrite phase having a crystal orientation satisfying ND//{101}±10° are present in a total amount of 10% by area or more.

2. A ferrite-austenite stainless steel sheet having excellent ridging resistance and workability, the steel sheet comprising: in terms of mass %, C: 0.1% or less;

Cr: 17 to 25%;

Si: 1% or less;

Mn: 3.7% or less;

Ni: 0.6 to 3%;

Cu: 0.1 to 3%;

N: 0.06% to less than 0.15%, and a balance of Fe and unavoidable impurities, wherein the steel sheet has a two-phase structure consisting of a ferrite phase and an austenite phase, a volume fraction of the austenite phase is in a range of 15 to 70%, and in a sheet plane (ND) of a center of a sheet thickness, grains of the ferrite phase having a crystal orientation satisfying ND//{111}±10° and grains of the ferrite phase having a crystal orientation satisfying ND//{101}±10° are present in a total amount of 10% by area or more.

3. The ferrite-austenite stainless steel sheet having excellent ridging resistance and workability according to claim 2, the steel sheet further comprising, in terms of mass %, one or more elements selected from the group consisting of Al: 0.2% or less, Mo: 1% or less, Ti: 0.5% or less, Nb: 0.5% or less, B: 0.01% or less, Ca: 0.01% or less, Mg: 0.01% or less, and rare-earth elements: 0.5% or less.

4. The ferrite-austenite stainless steel sheet having excellent ridging resistance and workability according to any one of claims 1 to 3, wherein a uniform elongation measured by a tensile testing is in a range of 30% or more.

5. A process for manufacturing a ferrite-austenite stainless steel sheet having excellent ridging resistance and workability, the process comprising:

heating a stainless steel slab at a temperature within a range of 1150 to 1300° C., the stainless steel slab comprising C: 0.1% or less; Cr: 17 to 25%; Si: 1% or less; Mn: 3.7% or less; N: 0.06% to less than 0.15%, and a balance of Fe and unavoidable impurities, optionally further comprising Ni: 0.6 to 3% and Cu: 0.1 to 3%, and optionally further comprising one or more elements selected from the group consisting of Al: 0.2% or less, Mo: 1% or less, Ti: 0.5% or less, Nb: 0.5% or less, B: 0.01% or less, Ca: 0.01% or less, Mg: 0.01% or less, and rare-earth elements: 0.5% or less;

subjecting the heated stainless steel slab to a hot rolling including a hot rough rolling and a hot finish rolling after the hot rough rolling to form a hot-rolled steel sheet; and annealing the hot-rolled steel sheet, wherein, in the hot rough rolling, a multi-pass rolling is carried out under conditions where a rolling start temperature is in a range of 1150° C. or higher, a rolling end temperature is in a range of 1050° C. or higher, and a pass interval is in a range of 2 seconds or more to 60 seconds or less, and thereby providing a steel sheet having a two-phase structure consisting of a ferrite phase and an austenite phase, in which a volume fraction of the austenite phase is in a range of 15 to 70%, and in a sheet plane (ND) of a center of a sheet thickness, grains of the ferrite phase having a crystal orientation satisfying ND//{111}±10° and grains of the ferrite phase having a crystal orientation satisfying ND//{101}±10° are present in a total amount of 10% by area or more.

6. The process for manufacturing a ferrite-austenite stainless steel sheet having excellent ridging resistance and workability according to claim 5, wherein, in the hot rough rolling, a number of passes having a rolling reduction rate of 20% or more is ½ or more of a total number of passes, and a rolling reduction rate of a pass having a highest rolling reduction rate is in a range of 50% or more, or a total of rolling reduction rates of two passes having high rolling reduction rates is in a range of 50% or more.

7. The process for manufacturing a ferrite-austenite stainless steel sheet having excellent ridging resistance and workability according to claim 5, wherein an end temperature of the hot finish rolling is set to be in a range of 900° C. or higher.

8. The process for manufacturing a ferrite-austenite stainless steel sheet having excellent ridging resistance and workability according to claim 5, the process further comprising:

subjecting the annealed hot-rolled steel sheet to one pass of a cold rolling at a rolling reduction rate of 50% or more, or two or more passes of a cold rolling with an intermediate annealing therebetween under conditions where a total of rolling reduction rates is in a range of 50% or more, thereby forming a cold-rolled steel sheet; and subjecting the cold-rolled steel sheet to a finish annealing at a temperature within a range of 900 to 1200° C.

9. The process for manufacturing a ferrite-austenite stainless steel sheet having excellent ridging resistance and workability according to claim 6, wherein an end temperature of the hot finish rolling is set to be in a range of 900° C. or higher.

10. The process for manufacturing a ferrite-austenite stainless steel sheet having excellent ridging resistance and workability according to claim 6, the process further comprising:

subjecting the annealed hot-rolled steel sheet to one pass of a cold rolling at a rolling reduction rate of 50% or more, or two or more passes of a cold rolling with an intermediate annealing therebetween under conditions where a total of rolling reduction rates is in a range of 50% or more, thereby forming a cold-rolled steel sheet; and subjecting the cold-rolled steel sheet to a finish annealing at a temperature within a range of 900 to 1200° C.

11. The process for manufacturing a ferrite-austenite stainless steel sheet having excellent ridging resistance and workability according to claim 7, the process further comprising:

subjecting the annealed hot-rolled steel sheet to one pass of a cold rolling at a rolling reduction rate of 50% or more, or two or more passes of a cold rolling with an intermediate annealing therebetween under conditions where a total of rolling reduction rates is in a range of 50% or more, thereby forming a cold-rolled steel sheet; and subjecting the cold-rolled steel sheet to a finish annealing at a temperature within a range of 900 to 1200° C.

* * * * *